United States Patent [19]

De Maria

[11] 4,039,018

[45] Aug. 2, 1977

[54] AWNING WINDOW CONSTRUCTION

[76] Inventor: Carmine De Maria, 39 E. Madison Ave., Collingswood, N.J. 08908

[21] Appl. No.: 609,736

[22] Filed: Sept. 2, 1975

[51] Int. Cl.[2] ..... E06B 3/32

[52] U.S. Cl. ..... 160/89; 49/63; 49/163; 160/187; 160/193

[58] Field of Search ..... 160/118, 89, 91, 159, 160/187, 193; 49/61, 63, 67, 158, 159, 162, 163, 168, 177, 178, 179, 180, 181, 183, 184, 188, 189

[56] References Cited

U.S. PATENT DOCUMENTS

| | | | |
|---|---|---|---|
| 1,129,497 | 2/1915 | Laragy | 49/178 |
| 1,298,187 | 3/1919 | Dunn | 49/163 |
| 1,387,479 | 8/1921 | Dutcher | 160/187 |
| 1,452,732 | 4/1923 | Dutcher | 160/187 |
| 1,757,048 | 5/1930 | Janeczko | 49/67 X |
| 2,076,194 | 4/1937 | Epstein et al. | 160/187 |
| 2,330,696 | 9/1943 | Exiner | 160/187 |
| 2,771,133 | 11/1956 | Haskell | 160/118 X |

*Primary Examiner*—Philip C. Kannan
*Attorney, Agent, or Firm*—Clarence A. O'Brien; Harvey B. Jacobson

[57] ABSTRACT

A window construction including a frame and inner and outer window structures is provided. The inner window structure is vertically shiftable in the frame a limited amount and may be swung horizontally inwardly toward an open position after being upwardly shifted in the frame from its lower position, the inner window structure and frame including coacting portions locking the inner window structure against swinging movement to the open position when the inner window structure is shifted downwardly relative to the window frame. The outer window structure includes upper and lower sections pivotally joined together along their adjacent marginal edge portions and the opposite ends of the upper and lower marginal portions of the upper and lower sections, respectively, includes outstanding guide pins slidably and rotably received in opposing vertical grooves formed in the opposite side upright portions of the window frame. The adjacent marginal portions of the upper and lower sections of the outer window structure may be displaced outwardly of the window construction frame whereby to "break" the outer window structure toward an open position. Removable pins are engaged with the upper portions of the opposite side uprights of the main frame below the guide pins. Accordingly, the outer window structure, when in the open position thereof with the adjacent marginal edge portions of the upper and lower sections displaced outwardly of the main window frame, may be selectively retained at an upper portion of the main window frame or allowed to shift downwardly toward a lower portion of the main window frame.

6 Claims, 7 Drawing Figures

Fig. 2
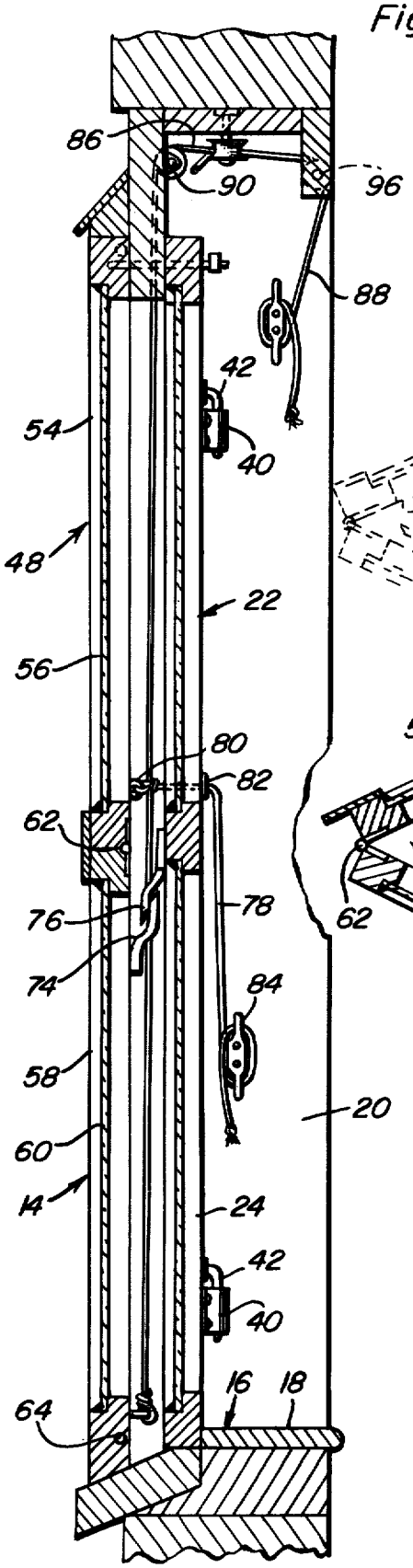
Fig. 3
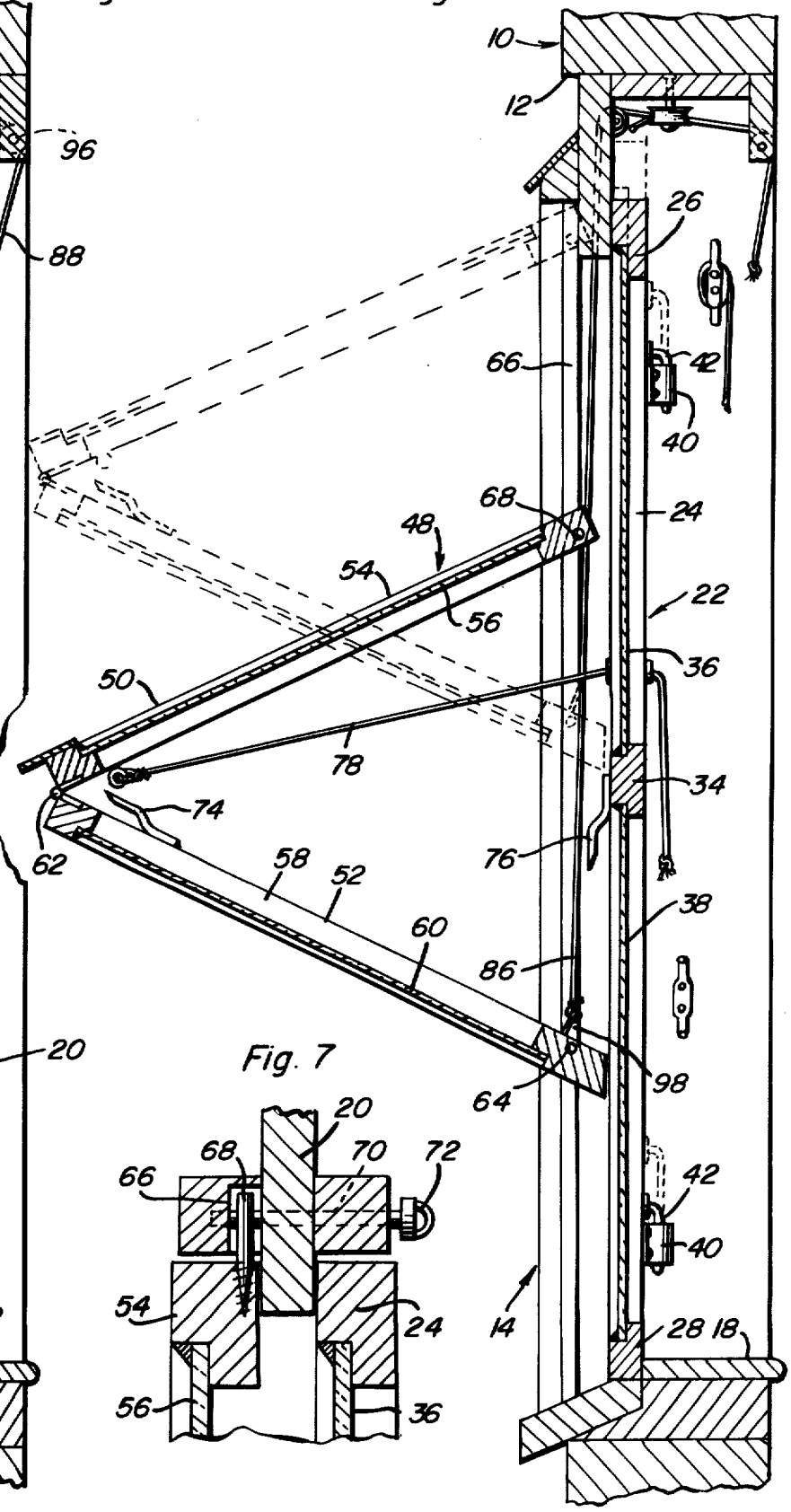
Fig. 7

AWNING WINDOW CONSTRUCTION

BACKGROUND OF THE INVENTION

Various forms of double window constructions including inner and outer window structures have been heretofore provided. However, some forms of double window constructions do not have the appearance of double hung windows while other forms of double window constructions include structural features which renders it substantially impossible or at least extremely difficult to wash both inner and outer sides of the inner and outer window structures from within an associated building. Still further, various forms of double window structures do not include features thereof whereby the opening defined by a partially open window construction is protected from inclined rain and/or snow.

Examples of various forms of previously known double window constructions as well as other window constructions including some of the general structural features of the instant invention are disclosed in U. S. Pat. Nos. 1,298,187, 1,839,554, 1,981,116 and 2,382,294.

BRIEF DESCRIPTION OF THE INVENTION

The window construction of the instant invention includes structural features whereby the inner and outer window structures thereof may be readily washed on both the inner and outer sides by a person disposed within an associated building structure. Further, the window construction includes features whereby automatic locking of the outer window structure in a closed position is accomplished by movement of the inner window structure to a fully closed position and the outer window structure may be opened in a manner to shield the open part of the window construction from inclined rain and snow.

The main object of this invention is to provide a double window construction having the appearance of a double hung window and yet which is constructed in a manner whereby the inner and outer surfaces of both the inner and outer window structures may be readily washed by a person disposed within the associated building.

Another object of this invention is to provide a double window construction including structure whereby movement of the inner window structure to the fully closed position while the outer window structure is in the closed position will automatically lock the outer window structure against movement toward its open position.

Still another important object of this invention is to provide a double window construction in accordance with the preceding objects and which utilizes an inner window structure horizontally inwardly swingable to an open position and an outer window structure which may "break" in the manner of a folding awning toward its open position.

A further object of this invention is to provide a double window construction including an outer window structure which may be opened downwardly or upwardly in relation to the main frame of the window construction.

A final object of this invention to be specifically enumerated herein is to provide a window construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is an enlarged vertical sectional view taken substantially upon the plane indicated by the section line 2–2 of FIG. 1 and with both the inner and outer window structures in fully closed positions;

FIG. 3 is a vertical sectional view similar to FIG. 3 but with the outer window structure illustrated in a first open position in solid lines and a second open position in phantom lines, an upwardly displaced position of the inner window structure preparatory to inward swinging movement of the inner window structure to its open position also being illustrated in phantom lines;

FIG. 7 is a fragmentary horizontal sectional view illustrating a removable locking pin for maintaining the upper portion of the upper section of the outer window structure in an upper position of the main window frame against downwardly displacement relative thereto.

DETAILED DESCRIPTION OF THE INVENTION

Figure 1:
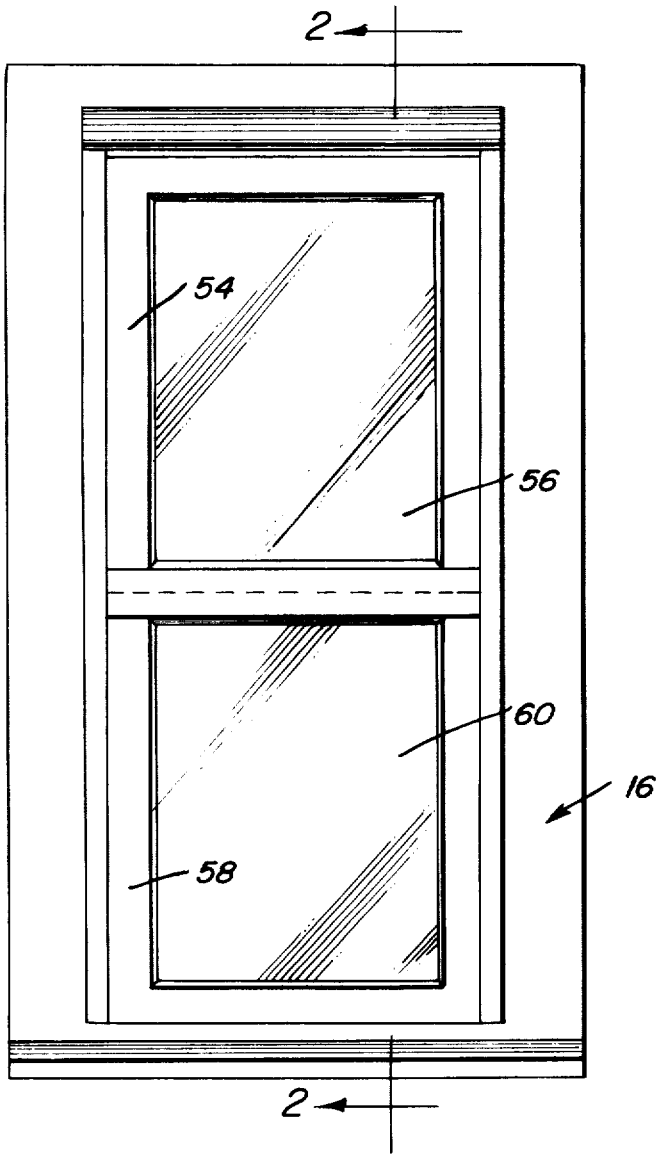
FIG. 1 is a plan view of the window construction of the instant invention as seen from the outer side thereof.

Referring now more specifically to the drawings the numeral 10 generally designates a wall of a building structure having a window opening 12 formed therein. The window construction of the instant invention is referred to in general by the reference numeral 14 and includes a main frame 16 secured within the opening 12 and provided with a lower horizontal sill portion 18 as well as upstanding opposite side portions 20.

Figure 4:
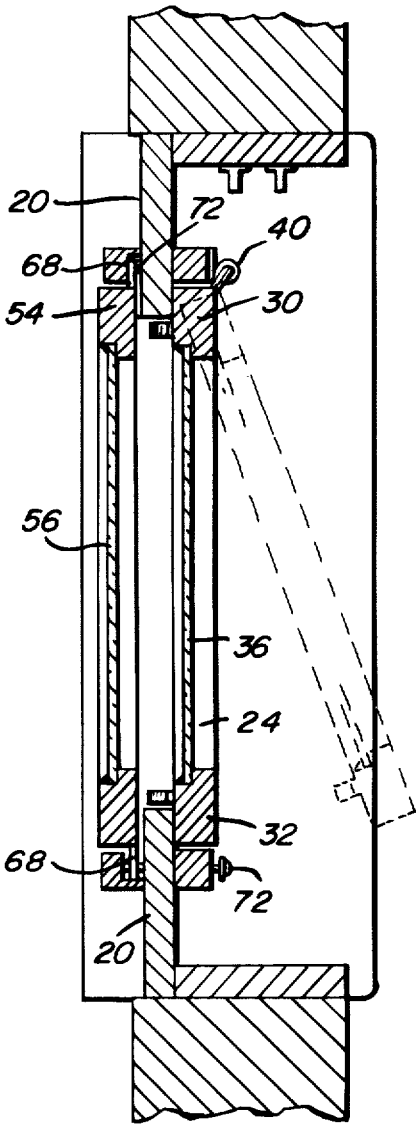
FIG. 4 is a horizontal sectional view illustrating the inner and outer window structures in closed positions and a partially opened position of the inner window structure in phantom lines.

An inner window structure referred to in general by the reference numeral 22 is provided and includes a frame 24 having upper and lower horizontal members 26 and 28 and opposite side upstanding members 30 and 32 in addition to a vertical mid-portion horizontal member 34. A pair of glass or other transparent panes 36 and 38 are secured within the frame 24 above and below the horizontal member 34. Also, the upstanding portion 20 disposed at the left side of the frame 24 when viewed from the inside includes a pair of vertically spaced and aligned sleeve brackets 40 and the vertical member 30 includes a pair of inwardly displaced and depending pivot pins 42 which are rotatably and slidably received in the sleeve brackets 40. In this manner, the inner window structure 22 may swing horizontally about a vertical axis between the closed position thereof illustrated in solid lines in FIG. 4 and the partially open position thereof illustrated in phantom lines in FIG. 4. However, the inner window structure 22 is vertically shiftable between the lower limit position thereof illustrated in solid lines in FIG. 3 and an upper limit position thereof illustrated in phantom in FIG. 3. When the window structure 22 is swung to the closed position and lowered to the lower limit position the lower horizontal member 28 is disposed exteriorly of the sill member 18 and the sill member or portion 18 thereby prevents horizontal inward swinging of the window structure 22 toward its open position. Of course, when it is desired to open the inner window structure 22, the latter is shifted upwardly sufficient for the lower horizontal member 28 to be elevated above the upper surface of the sill portion 18 and then swung to the open position.

The window construction 14 additionally includes an outer window structure referred to in general by the reference numeral 48 consisting of upper and lower window sections 50 and 52. The upper window section 50 includes a peripheral window frame 54 in which a transparent panel 56 is mounted and the lower window section 52 includes a similar window frame 58 in which a transparent panel 60 is mounted.

The adjacent lower and upper marginal edge portions of the sections 50 and 52 are pivotally secured together as at 62 and the opposite ends of the lower marginal edge portion of the frame 58 includes oppositely outwardly projecting guide pins 64 which are slidingly and rotatably received in inwardly opening and opposing grooves 66 formed in the upstanding side portions 20 of the frame 16. Further, the opposite ends of the upper marginal edge portion of the frame 54 include similar pins 68 also slidably and rotatably received in the grooves 66 and at least one of the upstanding portions 20 has a horizontal bore 70 formed therethrough opening into the corresponding grooves 66 and in which a retaining pin 72 is removably received for disposition immediately under the corresponding pin 68 when the outer window structure 48 is in the fully closed position illustrated in FIG. 2.

Figure 5:
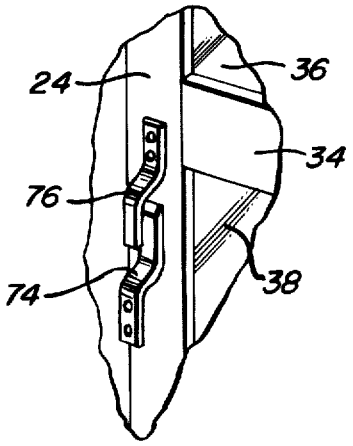
FIG. 5 is a fragmentary perspective view illustrating the interengaged components carried by the inner and outer window structures operable to lock the outer window structure against movement toward its open position when the inner window structure is in a fully closed position.

With attention now invited more specifically to FIGS. 2, 3 and 5 of the drawings it may be seen that the opposite side portions of the frame 58 adjacent the upper marginal edge portion thereof include inwardly offset and upwardly directed brackets 74 and that the opposite side portions of the frame 24 adjacent the opposite ends of the horizontal member 34 include outer outwardly offset and downwardly projecting brackets 76. From FIG. 2 of the drawings it will may be seen that the brackets 74 and 76 are engaged with each other in a manner preventing the adjacent marginal edge portions of the frames 54 and 58 from being outwardly displaced relative to the frame 16 when the inner window structure 22 is in the fully closed position. However, it will be noted that when the inner window structure 22 is in the closed position but upwardly displaced to its upper limit position the brackets, 76 will be elevated above the brackets 74 thereby allowing the adjacent marginal portions of the frames 54 and 58 to be displaced outwardly relative to the frame 16.

Figure 6:
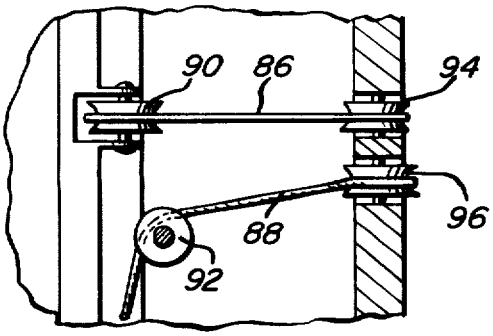
FIG. 6 is a horizontal sectional view illustrating the guiding pulley structures for a pair of tension members utilized to raise the outer window structure toward an open position.

A simple tension member 78 is provided and has one end portion thereof anchored to the lower marginal portion of the frame 54 as at 80 on the left side of the frame 54 as viewed from the inside of the window construction. The free end of the tension member 78 is slidingly received through a grommet 82 secured through the left side of the vertical member 30 of the frame 24 and may be suitably adjustably anchored to an anchor structure 84 carried by the inside of the upright portion 20 of the frame 16. Further, with attention now invited more specifically to FIGS. 3 and 6, a pair of flexible tension members 86 and 88 are guided about pulleys 90, 92, 94 and 96 journalled from the frame 16 at the upper portion thereof and one pair of corresponding ends of the tension members 86 and 88 are anchored to the opposite sides of the lower marginal portion of the frame 58 as at 98. Thus, the tension members 86 and 88 are disposed between the window structures 22 and 48.

In operation, assuming that both window structures 22 and 48 are in the fully closed position thereof illustrated in FIG. 2, if it is desired to open the inner window structure 22, the tension member 78 is loosened and the frame 24 is upwardly displaced to the upper phantom line position thereof illustrated in FIG. 3 and then swung toward the open position. If, however, it is desired to open the outer window structure 48, the tension member 78 is released from the anchor structure 84 and a pull is exerted on the tension members 86 and 88 whereby the outer window structure 48 will break outwardly and the lower marginal edge portion of the window frame 58 will slide upwardly along the grooves 66 to the open position illustrated in phantom lines in FIG. 3. Thereafter, if it is desired to lower the entire outer window structure 48 to the position thereof illustrated in solid lines in FIG. 3, the pin 72 may be withdrawn and the tension members 86 and 88 may then be used to lower the outer window structure 48 to the position thereof illustrated in solid lines in FIG. 3. Of course, both window structures 22 and 48 may be open at the same time.

It will be noted that when both window structures 22 and 48 are open the inner and outer surfaces of all of the window panes or panels may be readily cleaned from within the associated building structure. Further, if the inner window structure 22 is in the closed position and the outer window structure 48 is in the open position, it is merely necessary to pull inwardly on the tension member 78 in order to cause the adjacent marginal portions of the frames 54 and 58 to move inwardly toward the frame 16 while at the same time the ends of the tension members 86 and 88 attached to the frame 58 are lowered. Then, as the outer window structure 48 is completing its movement to the closed position thereof, the inner window structure 22 may be elevated to the upper limit position thereof and thereafter allowed to drop downwardly to the lower limit position after the outer window structure 48 is in the fully closed position to thereby lock the outer window structure 48 against movement toward the open position thereof.

Further, the window construction may be constructed of any desired size and may even be utilized as a non-transparent double closure for any building wall opening.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A window construction comprising a frame, full vertical length inner and outer window structures mounted in same frame, support means mounting one of said window structures in said frame for vertical shifting therein between upper and lower limit positions therein, the other of said window structures including upper and lower sections each having upper and lower marginal edges, means hingedly securing the lower and upper marginal edges of the upper and lower sections together, first coacting means on said frame and opposite end portions of the lower marginal edge of said lower section guiding the lower marginal edge from said frame for vertical movement therealong and for angular displacement relative thereto, and second coacting means hingedly supporting the upper marginal edge portion of said upper section for swinging relative to said frame, whereby the adjacent marginal edges of said upper and lower sections may be outwardly displaced from said frame while the lower marginal edge of said lower section shifts upwardly along said frame to open said other window structure, said support means including coacting portions on one upstanding edge portion of said one window construction and said frame also supporting said one window construction from said frame for inward horizontal swinging about an upstanding axis relative to said frame from a closed position to an open position, the vertical mid-portions of said window structures including third coacting means operative, when said other window structure is closed and said one window structure is in the closed position thereof and responsive to downward shifting of said one window structure from its upper limit position toward its lower limit position, to lock one of said adjacent marginal edges of said upper and lower sections relative to the vertical midportion of said one window construction against outward displacement relative thereto.

2. The combination of claim 1 wherein said one window construction and said frame include coacting locking means preventing said one window construction from swinging from said closed position thereof toward the open position thereof when said one window construction is in the lower limit position sand ineffective to prevent said one window construction from swinging from its closed position toward its open position when said one window construction is in its upper limit position.

3. A window construction comprising a frame, inner and outer window structures mounted in same frame, one of said window structures being mounted in said frame for vertical shifting therein between upper and lower limit positions therein, the other of said window structures including upper and lower sections each having upper and lower marginal edges, means hingedly securing the lower and upper marginal edges of the upper and lower sections together, first coacting means on said frame and opposite end portions of the lower marginal edge of said lower section guiding the lower marginal edge from said frame for vertical movement therealong and for angular displacement relative thereto, and second coacting means hingedly supporting the upper marginal edge portion of said upper section for swinging relative to said frame, whereby the adjacent marginal edges of said upper and lower sections may be outwardly displaced from said frame while the lower marginal edge of said lower section shifts upwardly along said frame to open said other window structure, said window structures including third coacting means operative, when said other window structure is closed and said one window structure is in the lower limit position thereof, to retain said adjacent marginal edges of said upper and lower sections against outward displacement relative to said frame and thus aid other window construction in a closed position, said third coacting means including means rendering said third coacting means inoperable to retain said adjacent marginal edges against outward displacement relative to said frame when said one window structure is shifted from its lower position to its upper limit position.

4. A window construction comprising a frame, inner and outer window structures mounted in same frame, one of said window structures being mounted in said frame for vertical shifting therein between upper and lower limit positions therein, the other of said window structures including upper and lower sections each having upper and lower marginal edges, means hingedly securing the lower and upper marginal edges of the upper and lower sections together, first coacting means on said frame and opposite end portions of the lower marginal edge of said lower section guiding the lower marginal edge from said frame for vertical movement therealong and for angular displacement relative thereto, and second coacting means hingedly supporting the upper marginal edge portion of said upper section for swinging relative to said frame, whereby the adjacent marginal edges of said upper and lower sections may be outwardly displaced from said frame while the lower marginal edge of said lower section shifts upwardly along said frame to open said other window structure, one upstanding edge portion of said one window construction and said frame including coacting support means supporting said one window construction for horizontal swinging between open and closed positions about an upstanding axis relative to said frame, said one window construction and said frame including coacting locking means preventing said one window construction from swinging from said closed position thereof to the open position thereof when said window is in the lower limit position and ineffective to prevent said one window construction from swinging from its closed position toward its open position when said one window construction is in its upper limit position, said window structures including third coacting means, when said other window structure is closed and said one window structure is in the lower limit position thereof, retaining said adjacent marginal edges of said upper and lowr sections against outward displacement relative to said frame and thus said other window construction in a closed position.

5. The combination of claim 4 wherein said third coacting means include means rendering said third coacting means inoperable to retain said adjacent marginal edges against outward displacement relative to said frame when said one window structure is shifted from its lower limit position to its upper limit position.

6. The combination of claim 5 wherein said second coacting means also includes means guiding the opposite end portions of the upper marginal edge of said upper section from said frame for vertical movement therealong and releasable means operative to retain said upper marginal edge of said upper section in an upper position relative to said frame.

* * * * *